United States Patent [19]

Kumai et al.

[11] Patent Number: 4,799,824

[45] Date of Patent: Jan. 24, 1989

[54] METHOD OF MAKING COVERING WALL OF TUNNEL MADE BY SHIELD TYPE EXCAVATOR

[75] Inventors: Fumitaka Kumai; Yoshihiro Takano, both of Tokyo, Japan

[73] Assignee: Tekken Construction Co., Ltd., Japan

[21] Appl. No.: 927,361

[22] Filed: Nov. 6, 1986

[30] Foreign Application Priority Data

Jul. 25, 1986 [JP] Japan ..... 61-176194

[51] Int. Cl.[4] ..... E21D 9/06; E21D 11/10; E04B 1/16

[52] U.S. Cl. ..... 405/146; 405/150; 249/11; 264/33; 264/34

[58] Field of Search ..... 405/138, 141, 144–146, 405/150, 155, 151, 153; 249/11; 264/31, 33, 34; 425/59

[56] References Cited

U.S. PATENT DOCUMENTS

| | | | |
|---|---|---|---|
| 852,891 | 5/1907 | Moir | 405/150 |
| 2,590,683 | 3/1952 | Clapp | 405/150 X |
| 3,561,223 | 2/1971 | Tabor | 405/144 |
| 4,519,730 | 5/1985 | Horimatsu | 405/258 |
| 4,557,627 | 12/1985 | Schmid et al. | 405/146 |
| 4,591,297 | 5/1986 | Horimatsu | 405/258 |
| 4,610,572 | 9/1986 | Horimatsu | 405/258 |
| 4,621,948 | 11/1986 | Hentschel | 405/150 X |

FOREIGN PATENT DOCUMENTS

| | | | |
|---|---|---|---|
| 1583082 | 4/1970 | Fed. Rep. of Germany | 405/146 |
| 625043 | 9/1978 | U.S.S.R. | 405/146 |

*Primary Examiner*—Randolph A. Reese
*Assistant Examiner*—John A. Ricci
*Attorney, Agent, or Firm*—Leydig, Voit & Mayer

[57] ABSTRACT

A method of making a primary concrete covering wall on the surface of the wall of a tunnel which extends behind a shield type tunnel excavator. A form structure for casting concrete to make the covering wall is assembled with a plurality of arcuate form assemblies respectively including form segments and timbering members for reinforcing the cast and set concrete. The form segments of each assembly are detachably coupled to the timbering member. The form structure is disassembled after the cast concrete is set by detaching the form segments of the respective assemblies from the timbering members to leave the members on the primary covering wall of the set concrete, whereby the primary covering wall can be held in stable state simultaneously with completion of the primary covering wall on the tunnel wall surface.

7 Claims, 6 Drawing Sheets

METHOD OF MAKING COVERING WALL OF TUNNEL MADE BY SHIELD TYPE EXCAVATOR

TECHNICAL BACKGROUND OF THE INVENTION

This invention relates to methods of making a wall on the peripheral wall surface of a tunnel. More particularly, this invention relates to a method of making a primary covering wall on the peripheral wall surface of the tunnel made by a shield type excavator. According to the method, the primary covering wall may be stabilized immediately after the wall is formed.

In a typical tunnel making method, a tunnel excavating system employs a shield type excavator. A shield of a steel-made cylinder of the excavator is driven into the ground at the tunnel face and a rotary cutter head provided in the front portion of the excavator is rotated to excavate the ground and bore the tunnel. While excavating the tunnel with such a shield type excavator, it is required to form a covering wall against the peripheral wall surface of the tunnel, which extends behind the excavator as the excavator is advanced.

DISCLOSURE OF PRIOR ART

In forming the covering wall against the tunnel wall surface, a plurality of arcuate reinforcing wall segments have been assembled in an annular configuration and installed against the peripheral wall of the bored tunnel to form the primary covering wall. Alternatively, concrete has been cast against the peripheral wall of the bored tunnel to form the primary covering wall. The concrete is cast by means of an annular casting form installed facing the peripheral wall of the tunnel. Since it is often impossible to resist the tunnel ground pressure with such primary covering walls alone, a plurality of arcuate timbering members made of steel must be assembled in an annular configuration and installed against the primary covering wall. A secondary covering wall having a better appearance is further provided over the primary covering wall.

In the method using the reinforcing segments, however, there has been a problem that the annular installation of many of the segments is rather complicated, increasing the number of workers, the time, and the cost for tunnel excavation. In addition, it has been almost impossible to bring the annularly assembled segments into close contact with the peripheral wall of the tunnel. Consequently, there is inevitably a gap between the segments and the peripheral wall and the gap must be back-filled with mortar or the like, further complicating the formation of the covering wall. On the other hand, by directly casting concrete on the peripheral wall of the tunnel with the casting form, the primary covering wall may be formed in close relation to the peripheral tunnel wall as the excavator advances and the casting form is installed annularly behind the advancing. However, excavator it takes a relatively long time for the timbering members to be assembled because the concrete must first set and the frame segments must then be removed. Thus, the timbering members is not assembled at the same time the primary covering wall is formed. Accordingly, certain problems arise. For example, after removal of the frame segments and before installation of the timbering members, the primary covering wall may not be stable enough to sufficiently resist the ground pressure, posing safety hazard. Further, if the advancing of the excavator as well as the formation of the primary covering wall are delayed to conform to the required assembling time of the timbering members, then the required tunnel construction period will have to be greatly prolonged.

TECHNICAL FIELD OF THE INVENTION

A primary object of the invention is, therefore, to provide an improved method of making a primary covering wall on the peripheral wall of a tunnel which is bored by a shield type excavator. More specific objects include stabilizing the primary covering wall simultaneously with completion of the wall while maintaining merits of the kown method of casting concrete directly against the peripheral wall of the tunnel.

According to the present invention, the above object is attained by providing a method of making a covering wall on a peripheral wall surface of a tunnel extending behind a shield type excavator, the method comprising the step of preparing a plurality of form assemblies respectively comprising a form segment for use in casting concrete for the primary covering wall and a timbering member for reinforcing the primary covering wall. Preparing each form assembly includes the step of detachably coupling the form segment to the timbering member. The method also comprises the step of installing a covering-wall form structure including the step of assembling the covering-wall form structure from the form assemblies with their timbering members opposed to the peripheral tunnel wall surface. The method further comprises the steps of, casting concrete into a space defined between the peripheral tunnel wall surface and the covering-wall form structure to form the primary covering wall and removing the form structure after the cast concrete has set. Removing the form structure includes detaching the form segments from the timbering members but leaving the timbering members installed against the primary covering wall of the set concrete.

Thus, according to the present invention, the timbering members are installed against the primary covering wall simultaneously with the formation of the primary covering wall to immediately reinforce and stabilize the primary covering wall against the ground pressure at the tunnel. Consequently, safety in the interior of the tunnel formed behind the excavator can be immediately secured. Further, since the timbering members and form segments are assembled simultaneously into the form structure for the primary covering wall, it is possible to minimize to a large extent the construction time and thus the construction costs required for the tunnel formation.

Other objects and advantages of the present invention shall be made clear in the following description of the invention detailed with reference to a preferred example of the method shown in accompanying drawings.

While the present invention shall now be described with reference to the preferred embodiments, it should be understood that the intention is not to limit the invention only to the particular embodiments shown, but rather to cover all alternatives, modifications and equivalent arrangements possible within the scope of appended claims.

DISCLOSURE OF PREFERRED EMBODIMENTS

Figure 1:
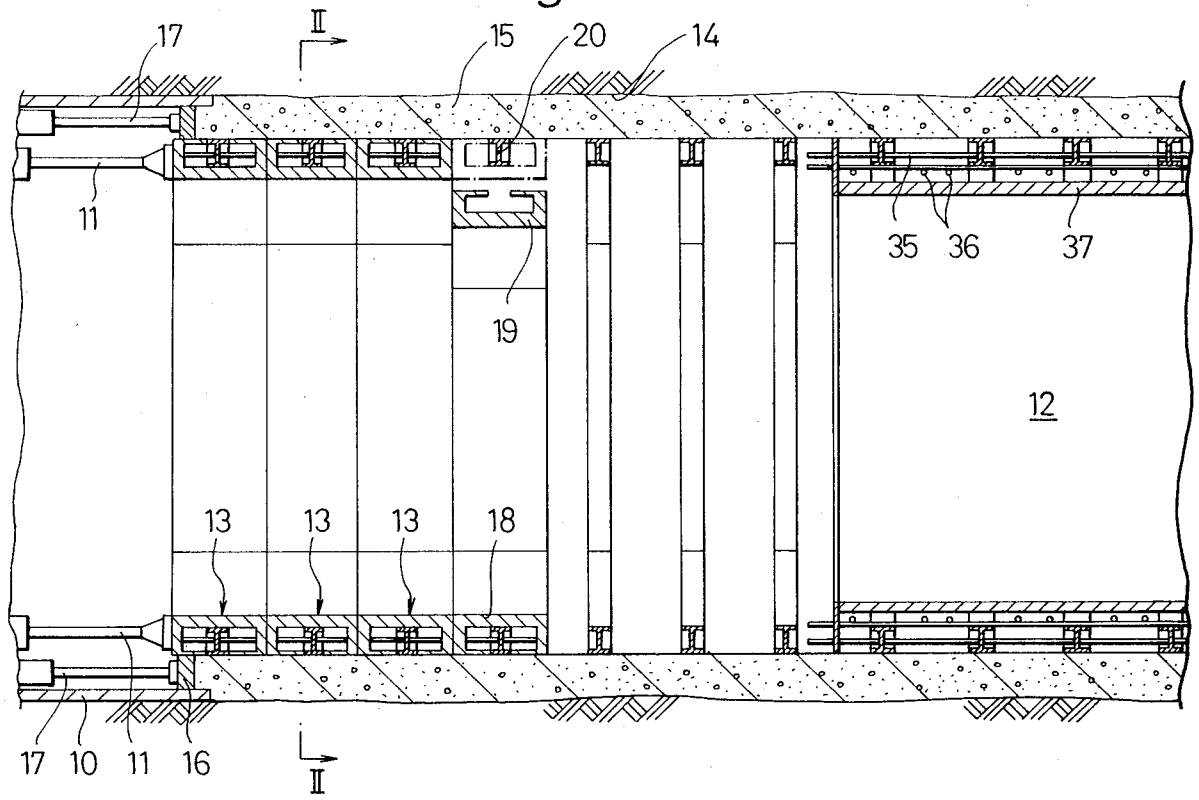
FIG. 1 shows in a schematic sectional view a state in which primary and secondary covering walls are continuously made against the peripheral wall surface of a tunnel excavated by a shield type excavator, according to an embodiment of the present invention.

Referring to FIG. 1, there is shown a tail section 10 of the shield type tunnel excavator. Conventionally, at front part of the excavator, cutter chamber is defined by a bulkhead, neither of which is shown here. The cutter chamber includes a rotary cutter for excavating the tunnel face ground. A pressurized liquid may be fed into the chamber so that a pressurized muddy mixture of the liquid and excavated ground may be formed to prevent the tunnel face ground from collapsing during the excavation. Arranged mutually circumferentially spaced within the tail section 10 of the shield type excavator are a plurality of shield propelling jacks 11, and the plungers of the jacks 11 extend in the axial rearward direction of the excavator. The jacks 11 are fixedly mounted at their cylinder end to the inner wall of the excavator. The plungers abut the foremost end of the foremost one of the covering-wall form structures 13, which are installed in multiple stages sequentially behind the tail section 10 of the excavator within the excavated tunnel 12. Therefore, as the plungers of the jacks 11 are extended rearward following the excavation of the tunnel face ground by the rotary cutter, the excavator is propelled forwardly so as to extend the tunnel 12 in propelled direction of the excavator.

The covering-wall form structure 13 on the rear side of the excavator is shaped in an annular form and is spaced radially from peripheral wall surface 14 of the tunnel 12. The form structure 13 is sequentially assembled into its annular shape as the excavator advances, so that the structure 13 will be partly positioned inside the tail section 10. As the excavator is advanced, a space defined by the peripheral wall surface 14 of the tunnel 12 and the covering-wall form structure 13 is fully and densely filled with a concrete material which is cast through a concrete inlet (not shown) provided in a part of the structure 13 to form in the space the primary covering wall 15. In this case, a radially-expanded annular end frame 16 is disposed between the inner peripheral wall of the tail section 10 and the outer peripheral surface of the foremost covering-wall form structure 13. Abutting the annular end frame 16, the rearward extended plunger ends of a plurality of circumferentially spaced pressing jacks 17 are fixedly mounted within the excavator in similar manner to the jacks 11. The jacks 17 function to push the end frame 16 against the pressure of concrete being filled in the spaced defined between the tunnel wall surface 14 and the covering-wall form structure 13 to thereby bring the primary covering wall 15 into tight engagement with the tunnel wall surface.

Figure 2:
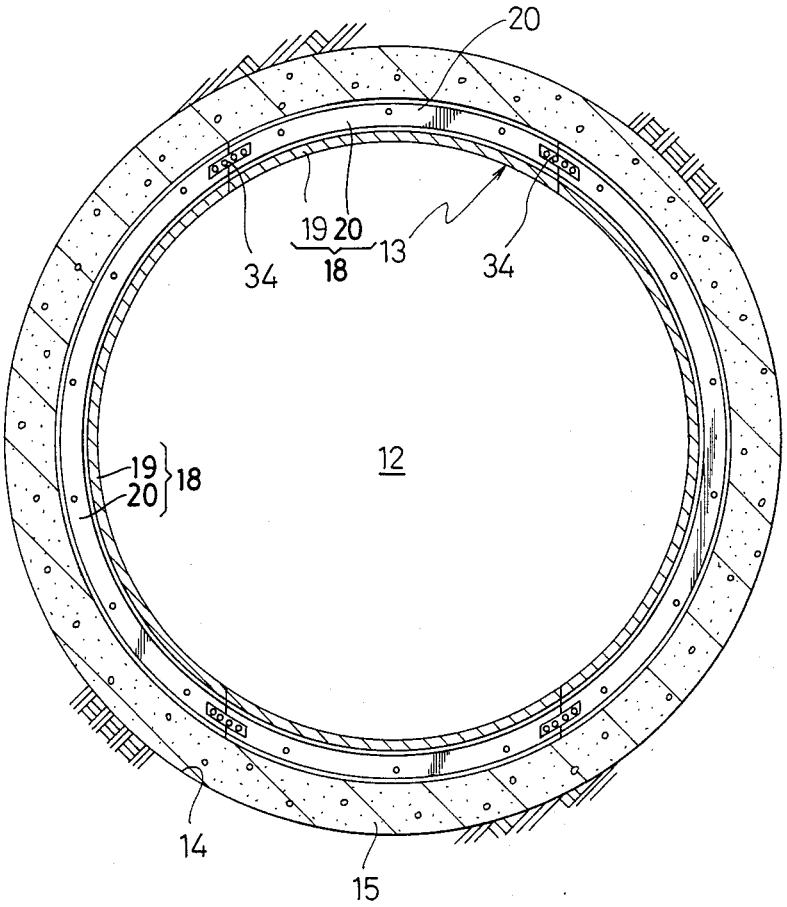
FIG. 2 is a cross-sectional view of the primary covering wall taken along line II—II in FIG. 1.
Figure 3:
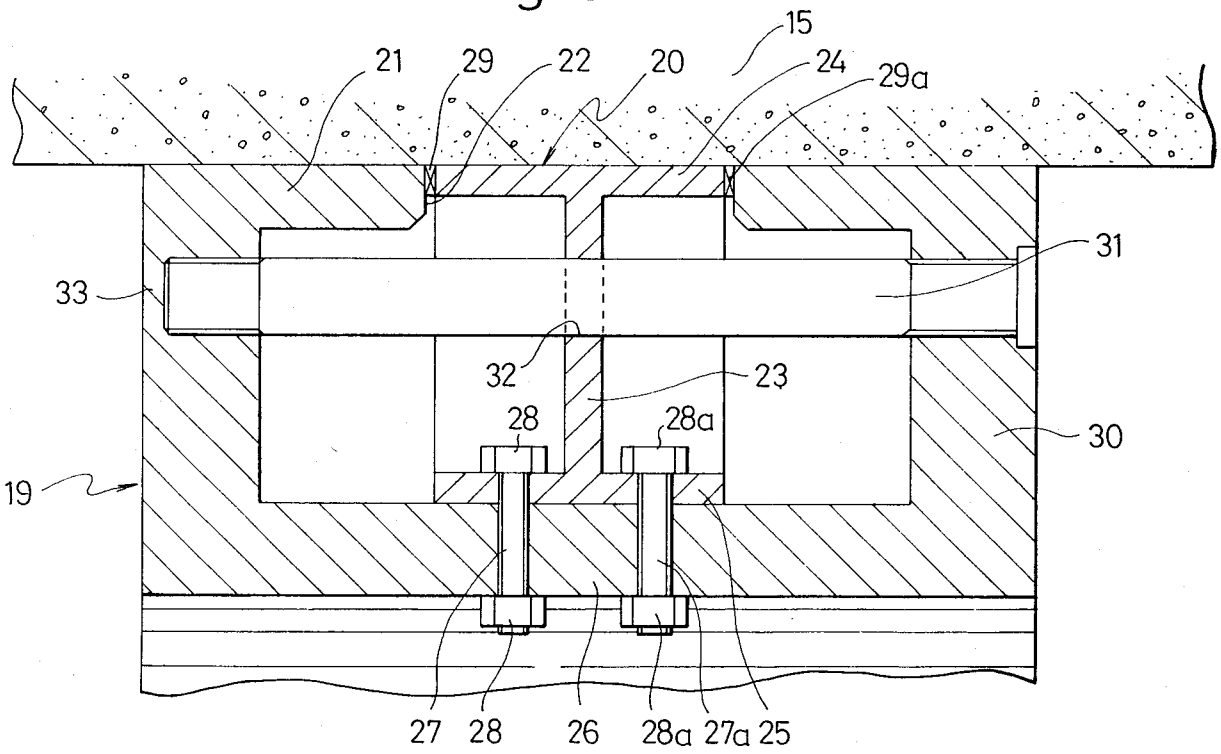
FIG. 3 is a magnified, fragmentary sectional view of a form structure used in forming the primary covering wall shown in FIG. 1.

Referring next to FIGS. 2 and 3, the covering-wall form structure 13, which is unique in the present invention, comprises a plurality of arcuate form assemblies 18 arranged in an annular shape and interlinked with each other. Each of the form assemblies 18 includes an arcuate form segment 19 functioning as a form for casting concrete in forming the primary covering wall 15 and an arcuate timbering member 20 having the same curvature as the form segment 19 and functioning as reinforcement for the primary covering wall 15. The form segment 19 is preferably made of a metallic material, has a generally C-shaped section, and is provided with an opening 22 which extends in the circumferential direction in its outer wall portion 21 facing the primary covering wall 15. The timbering member 20 is preferably made of a steel material and has a generally I-shaped section including a central web portion 23 extending in the radial direction an outer and inner arcuate flange portion 24 and 25 respectively continuously connected to both ends of the web portion 23.

In the illustrated embodiment, the form segment 19 is detachably coupled to the timbering member 20 by means of bolts 27, 27*a* and nuts 28, 28*a* such that the bolts 27 and 27*a* are passed radially inwardly through the inner flange portion 25 of the timbering member 20 as well as the inner wall portion 26 of the form segment 19. The nuts 28, 28*a* are fastened to the bolts 27, 27*a* on the inside of the inner wall portion 26 of the form segment 19 urging the nuts 28, 28*a* against the inner periphery of the form segment 19 and thus clamping the inner flange portion 25 of the timbering member 20 and the inner wall portion 26 of the form segment 19 tightly together. On the other hand, the outer flange portion 24 of the H-shaped timbering member 20 is positioned in the opening 22 of the C-shaped form segment 19 so that the outer surface of the outer flange portion 24 is flush with the outer surface of the outer wall portion 21 of the segment 19. Sealing materials 29, 29*a* are provided between opposing edges of the outer flange portion 24 of the timbering member 20 and the opening 22 of the segment 19. Therefore, the outer flange portion 24 of the member 20 functions as a part of the form segment 19 during the casting of the concrete to form the primary covering wall 15. Thus when the cast concrete sets, the arcuate flange portion 24 comes into tight contact with the inner peripheral surface of the primary covering wall 15.

The form segment 19 further has a plurality of reinforcing bolts 31 (only one of which is illustrated) which are passed through one radial side wall 30 of the segment 19 and further through aligned through-holes 32 provided in the central web 23 of the timbering member 20 the reinforcing bolts 31 are screwedly coupled at their leading ends to the other side wall 33 of the segment 19, so as to increase the strength of the segment 19 particularly in the axial direction of the tunnel 12. A plurality of such form assemblies 18 are arranged annularly into a ring shape and interconnected to each other by any proper means, so as to assemble them into the covering-wall form structure 13. Advantageously, the interconnecting means should be joining plates 34 which join, with bolts and nuts, respective abutting ends of the web portions 23 of the timbering members 20, as seen in FIG. 2. For this purpose, preferably, the abutting ends of the timbering members 20 should be made accessible through the segments 19.

Now, steps of making the primary covering wall 15 will be briefly explained. As already explained above, the form assemblies 18, each comprising the form segment 19 and timbering member 20 detachably coupled to each other, are preliminarily prepared, the annular form structure 13 being assembled from each set of the form assemblies 18 into the annular shape. The form structure 13 is assembled after the excavator is advanced by a distance substantially corresponding to axial length of each structure 13, is located partly in the tail section 10 of the shield type excavator, and is peripherally spaced by a desired thickness for the primary covering wall 15 from the peripheral tunnel wall surface. The annular covering-wall form structure 13 is installed in sequence to a previously installed structure, as seen in FIG. 1. The assemblies 18 forming each structure 13 are circumferentially interlinked by means of the joining plates 34 between the respective timbering members 20 as seen in FIG. 2, with the segments 19 coupled to the members 20 through the bolts 27, **27*a* and nuts 28, 28*a* as shown in FIG. 3. In this state, the outer arcuate walls of the segments 19 and of the timbering members 20 oppose the peripheral tunnel wall surface 14**.

Next, with the tunnel extended, concrete is cast into the space defined by the peripheral tunnel wall surface 14 and the covering-wall form structure 13. At the same time, the pressing jacks 17 are actuated to push the end frames 16 against the cast concrete. As a result, a new part of the primary covering wall 15 is formed in the region defined by the previously formed part of the primary covering wall 15, the tunnel wall surface 14, the form structure 13, and the end frames 16. The newly formed primary covering wall 15 are subjected to a pushing force through the end frames 16 from the jacks 17 since beginning of the concrete casting, so that the new part of the primary covering wall 15 tightly abuts the tunnel wall surface 14 and the outer surfaces of the outer arcuate flange portions 24 of the timbering members 20 that are flush with the other surfaces of the outer arcuate wall portions 21 of the segments 19.

While the cast concrete is curing, new parts of the primary covering wall 15 are sequentially formed with the repetitive advance of the excavator and sequential assembly of further sets of the form structures 13. Once the concrete at the rearmost set of the sets 13 has completely set, the set is disassembled by detaching the nuts 28 and, **28*a* from the inner arcuate wall portion 26 of the respective segments 19, detaching the reinforcing bolts 31 from the segments 19 and timbering members 20, and detaching the segments 19 from the timbering members 20. The timbering members 20, mutually coupled by the joining plates 34, are left on the primary covering wall 15. Thus, simultaneously with the completion of the primary covering wall 15, the timbering members 20 are left as installed against the primary covering wall 15 for its reinforcement. Thus, stabilization is achieved immediately after the disassembling of the form structure 13, and the primary covering wall 15** is immediately resistive to the ground pressure, assuring the safety in the interior of the excavator and excavated tunnel.

After the forming of the primary covering wall 15, a plurality of reinforcing steels 35, 36 are further assembled over the timbering members 20, which are left on the primary covering wall 15 in the tunnel 12 at a remote position from the excavator and behind the covering-wall form structures 13. The reinforcing steels 35, 36 extend in the axial and radial directions of the tunnel 12. A secondary covering-wall form structure 37 is then assembled on the reinforcing steels 35 and 36, and wall material is fed therein to form a secondary covering wall, as seen in FIG. 1.

Figure 4:
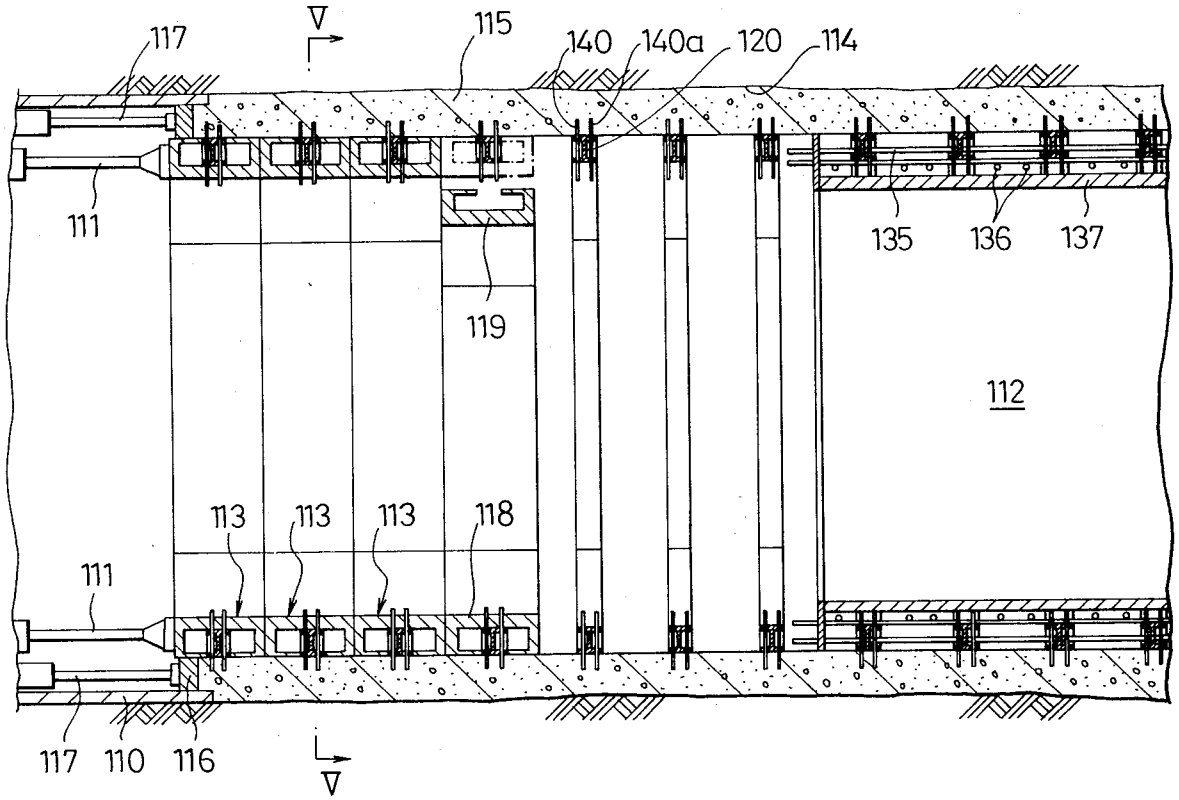
FIG. 4 shows in a schematic sectional view a state in which primary and secondary covering walls are continuously made against the peripheral wall surface of a tunnel excavated by a shield type excavator, according to another embodiment of the present invention.
Figure 5:
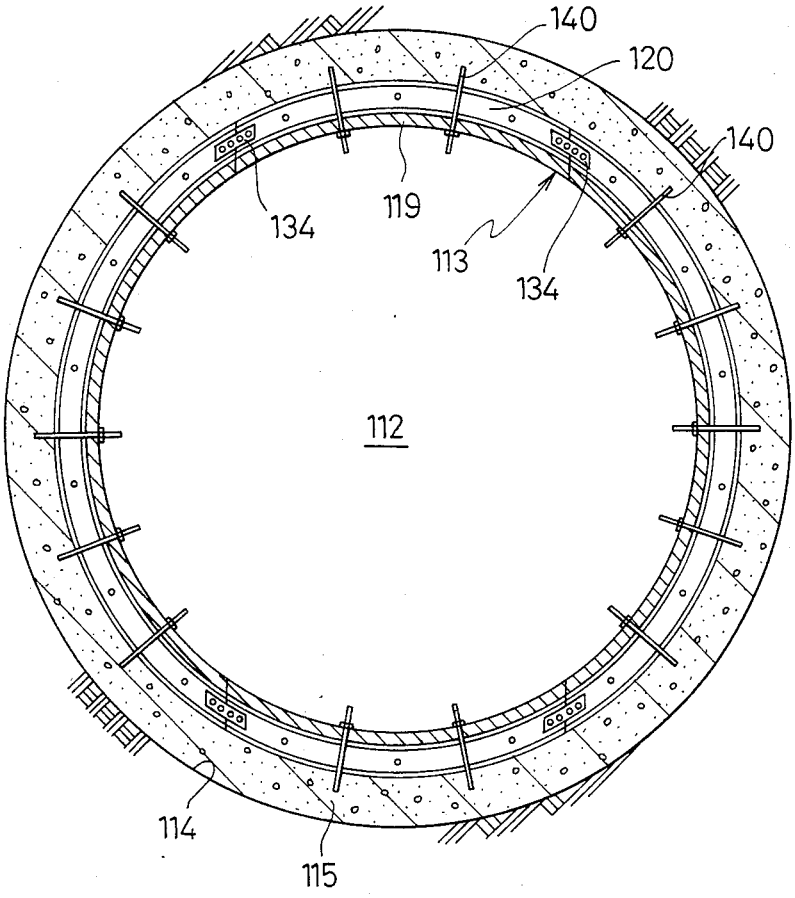
FIG. 5 is a cross-sectional view of the primary covering wall taken along line V—V in FIG. 4.
Figure 6:
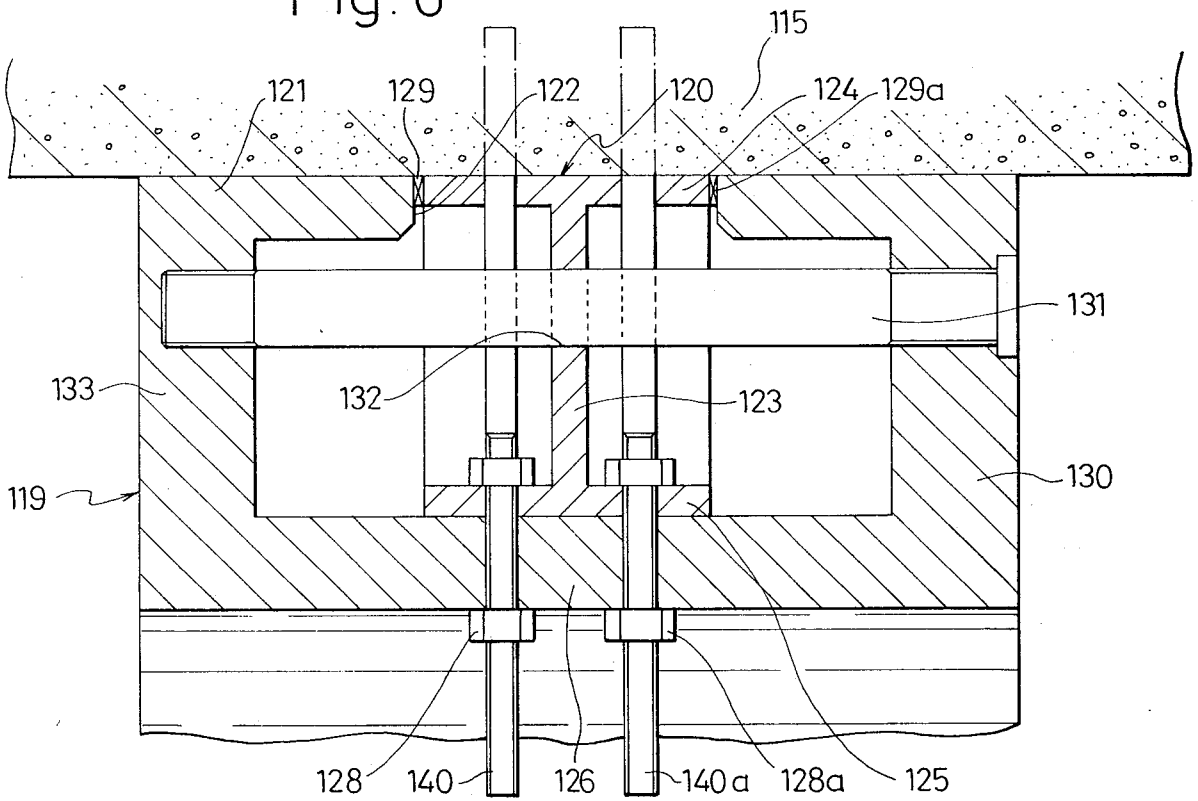
FIG. 6 is a magnified fragmentary sectional view of a form structure used in forming the primary covering wall shown in FIG. 4.

Referring next to FIGS. 4 through 6 showing another embodiment of the present invention, substantially the same elements as in the foregoing embodiment of FIGS. 1 through 3 are denoted by the same reference numbers but increased by 100. As will be clear when FIG. 6 is compared with FIG. 3, the present embodiment is different from the foregoing embodiment in that, in particular, anchor bolts 140, **140*a* are employed in place of the bolts 27, 27*a*. In the present embodiment a form assembly 118 also comprises a form segment 119 and a timbering member 120 detachably coupled to the segment. Anchor bolts 140, 140*a* are provided to be radially passed from the inside of the form segment 119 through its inner arcuate wall portion 126, the inner arcuate flange portion 125 of the timbering member 120, and the outer arcuate flange portion 124 of the timbering member 120. The anchor bolts 140, 140*a* project radially outwardly from the flange portion 124. Preferably the anchor bolts 140, 140*a* are made to be long enough to also allow their inner ends to project radially inwardly from the inner wall portion 126 of the segment 119 substantially to a level where reinforcement steel bars 135 and 136 for the later formed secondary covering wall are provided. Upon assembling the covering-wall form structure 113 the outer ends of the anchor bolts 140, 140*a* are initially positioned substantially to be flush with the outer periphery of the outer arcuate flange portion 124 of the timbering member 120. The anchor bolts 140, 140*a* are so secured to the segment 119 and timbering member 120 as to tightly clamp the segment 119 and member 120 together by means of nuts 128, 128*a* urged against the inner periphery of the segment 119**.

In performing the method in the present embodiment, the nuts 128, **128*a* having been thus fastened are unfastened after casting the concrete for forming the primary covering wall 115 with the form structure 113 but before full setting of the cast concrete. The anchor bolts 140, 140*a* are then driven radially outwardly so that their outer ends are projected into the cast concrete. In detaching the form segment 119 from the timbering member 120, the anchor bolts 140, 140*a* are left secured to the timbering member 120 and embedded at the outer ends in the cast concrete of the primary covering wall 115. The nuts 128 and 128*a* are then urged against the inner flange portion 125 of the timbering member 120**.

Other steps of the method, other arrangements for the covering-wall form structure and so on and their operation are substantially the same as those referred to in the foregoing embodiment of FIGS. 1 to 3. In the present embodiment, in particular, the timbering members 120 of the disassembled form structure 113 are integrally coupled to the primary covering wall 115 with the outer projected ends of the anchor bolts embedded therein, so that the primary covering wall can be further additionally stabilized. With the anchor bolts of the timbering members 120 extending across both primary and secondary covering walls and with the timbering members 120 held between them, the covering walls can be more integrally secured. Yet, the timbering members 120 are sufficiently strengthened by the anchor bolts 140, **140*a*** so that, if required, the timbering members can be reduced in their height so that the form structure can be minimized in weight.

It should be appreciated that various design modifications can be made in the present invention. For example, the reinforcing bolts 31, 131 referred to as being employed in association with the form segments 19, or 119 may be replaced by any type of ribs integrally provided to the segment for reinforcing its structure. While in the embodiment of FIGS. 4 to 6 the form segment and timbering member are detachably coupled by means of the anchor bolts 140, 140*a*, the detachable coupling may be achieved by bolt-and-nut means similar to that disclosed with reference to the embodiment of FIGS. 1 to 3, except the anchor bolts 140, 140*a* to outwardly radially outward from the timbering member 120.

What is claimed as my invention is:

1. A method of making a covering wall on a peripheral wall surface of a tunnel extending behind a shield type excavator, said method comprising the steps of preparing a plurality of form assemblies respectively comprising a form segment for use in casting concrete for forming a primary covering wall and a timbering member for reinforcing said primary covering wall, said step of preparing the form assemblies including the step of detachably coupling said form segment to said timbering member; installing a covering-wall form structure, said step of installing the form structure including the step of assembling the covering-wall form structure from said form assemblies with their timbering members opposed to said peripheral tunnel wall surface; casting concrete into a space defined between the peripheral tunnel wall surface and said covering-wall form structure to form the primary covering wall; and removing the form structure after said cast concrete has set, said step of removing the form structure including detaching the form segments from the timbering members but leaving the timbering members installed against the primary covering wall of the set concrete.

2. A method according to claim 1, wherein said step of casting concrete for forming said primary covering wall comprises a step of projecting anchor bolts held by said timbering member into said cast concrete.

3. A method according to claim 1, wherein said step of casting concrete into said space between the peripheral tunnel wall surface and said covering-wall form structure includes applying a pressing force in an axial direction away from said excavator through annular end frames disposed at the forward end of the space by means of a plurality of pushing jacks, thereby closely engaging said primary covering wall with the peripheral tunnel wall surface.

4. The method according to claim 1 further comprising the step of making a secondary covering wall on the primary covering wall.

5. A method according to claim 1 wherein the step of casting concrete for forming said primary covering wall comprises applying a pressing force in an axial direction away from said excavator by means of a plurality of pressing jacks, thereby closely engaging the primary covering wall with the peripheral tunnel wall surface, and wherein the method further comprises abutting the foremost end of the primary covering-wall form structure with additional excavator-propelling jack plungers.

6. A method of making a covering wall on a peripheral wall surface of a tunnel extending behind a shield type excavator, said method comprising the steps of preliminarily preparing a plurality of arcuate form assemblies respectively comprising an arcuate form segment for use in casting concrete for forming a primary covering wall and an arcuate timbering member for reinforcing said primary covering wall, said step of preliminarily preparing the form assemblies including the step of detachably coupling the form segments to said timbering members so that the outer surfaces of the form segments and the timbering members are flush with each other; installing an annular primary covering-wall form structure, said step of installing the form structure including assembling the annular covering-wall form structure from said form assemblies with said flush outer surfaces of the form segments and timbering members opposed to said peripheral tunnel wall surface; casting concrete into a space defined between the peripheral tunnel wall surface and said flush outer surfaces of said annular primary covering-wall form structure to form the primary covering wall; removing the form structure after said cast concrete has set, said step of removing the form structure including detaching the form segments from the timbering members but leaving the timbering members installed on and against the primary covering wall of the set concrete; and making a secondary covering wall on the primary covering wall, said step of making a secondary covering wall including installing a secondary form structure with respect to the timbering members left on the primary covering wall and feeding wall material between the primary covering wall and the secondary form structure to thereby embed the timbering members in the wall material.

7. A method according to claim 6 wherein the step of casting concrete for forming said primary covering wall comprises projecting radially outwardly into said cast concrete anchor bolts held by said timbering members.

* * * * *